United States Patent [19]

Moore, Jr. et al.

[11] Patent Number: 5,074,464

[45] **Date of Patent: * Dec. 24, 1991**

[54] FORCED DRAFT DIRECT VENT SYSTEM FOR A WATER HEATER

[75] Inventors: Henry J. Moore, Jr., Playa Del Ray; Wouter J. Wiersma, Arcadia, both of Calif.; John M. Fabrizio, Bath, Ohio

[73] Assignee: Mor-Flo Industries, Inc., Cleveland, Ohio

[ * ] Notice: The portion of the term of this patent subsequent to May 15, 2007 has been disclaimed.

[21] Appl. No.: 463,522

[22] Filed: Jan. 11, 1990

Related U.S. Application Data

[63] Continuation-in-part of Ser. No. 268,716, Nov. 9, 1988, Pat. No. 4,925,093.

[51] Int. Cl.[5] ..... F24D 9/00

[52] U.S. Cl. ..... 237/19; 126/101

[58] Field of Search ..... 237/8 R, 19, 16, 17; 165/48.1; 236/25 R; 126/101

[56] References Cited

U.S. PATENT DOCUMENTS

| | | | |
|---|---|---|---|
| 1,643,859 | 9/1927 | Sauvage . | |
| 1,707,281 | 4/1929 | Sauvage . | |
| 1,713,442 | 5/1929 | Matcovich . | |
| 1,826,748 | 10/1931 | Delamere . | |
| 2,348,950 | 5/1944 | Anderson | 236/45 |
| 2,385,854 | 10/1945 | Wolfersperger | 158/99 |
| 3,280,774 | 10/1966 | English | 110/162 |
| 3,741,710 | 6/1973 | Nelson | 431/90 |
| 3,759,230 | 9/1973 | Cooksley | 122/156 |
| 4,204,832 | 5/1980 | Miller | 431/20 |
| 4,262,608 | 4/1981 | Jackson | 110/162 |
| 4,303,042 | 12/1981 | Sumiyoshi | 122/17 |
| 4,397,296 | 8/1983 | Moore, Jr. et al. | 126/360 |
| 4,549,525 | 10/1985 | Narang | 126/361 |
| 4,641,631 | 2/1987 | Satana | 126/101 |
| 4,660,541 | 4/1987 | Moore | 126/360 |
| 4,664,096 | 5/1987 | Narang | 126/351 |
| 4,672,919 | 6/1987 | Staats | 122/13 R |
| 4,798,240 | 1/1989 | Gerstmann et al. | 237/19 X |
| 4,828,171 | 5/1989 | Akin et al. | 237/19 |
| 4,848,655 | 7/1989 | Woodin et al. | 237/19 X |

OTHER PUBLICATIONS

Brochure, State Water Heaters, State Industries, Inc., "Contained Combustion Gas Water Heater".

AMTI Heatmaker, Amti Heating Products, Inc.-PN26-00-707.

Heatmaker, "A New Way to Heat your Home and Water" by BGP Systems, copyright 1981.

AMTI Heatmaker, Installation and Operating Intructions, Bulletin 86-4 by AMTI Heating Products, Inc. 1986.

*Primary Examiner*—Henry A. Bennett

*Attorney, Agent, or Firm*—Body, Vickers & Daniels

[57] ABSTRACT

A combined air and water temperature conditioning system provides for the heating of potable water and for the heating and cooling of indoor room air in a compact arrangement of components. A domestic type gas water heater having a driven draft direct vent system accepts a modular air handler on its top. The air handler comprises a heating coil within a closed loop water system and a pump circulating hot water between the water heater and the air handler coil. A blower in the air handler passes room air across the heating coil to an air outlet from an air inlet. An insertable second coil connected to a heat pump or air conditioner is optionally provided for heating or cooling air being propelled between the air inlet and outlet.

20 Claims, 6 Drawing Sheets

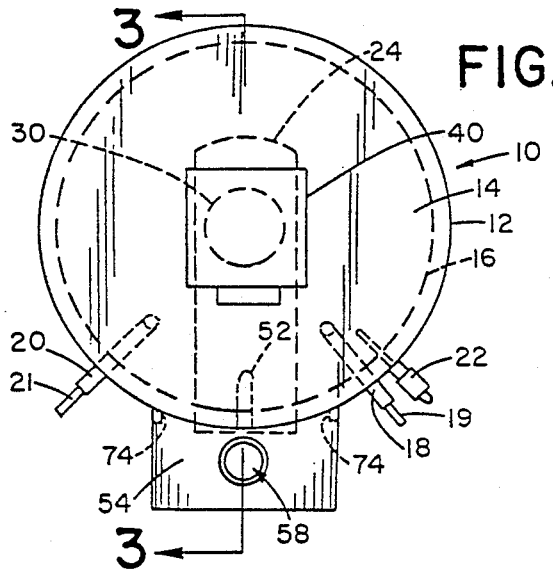
FIG. 2
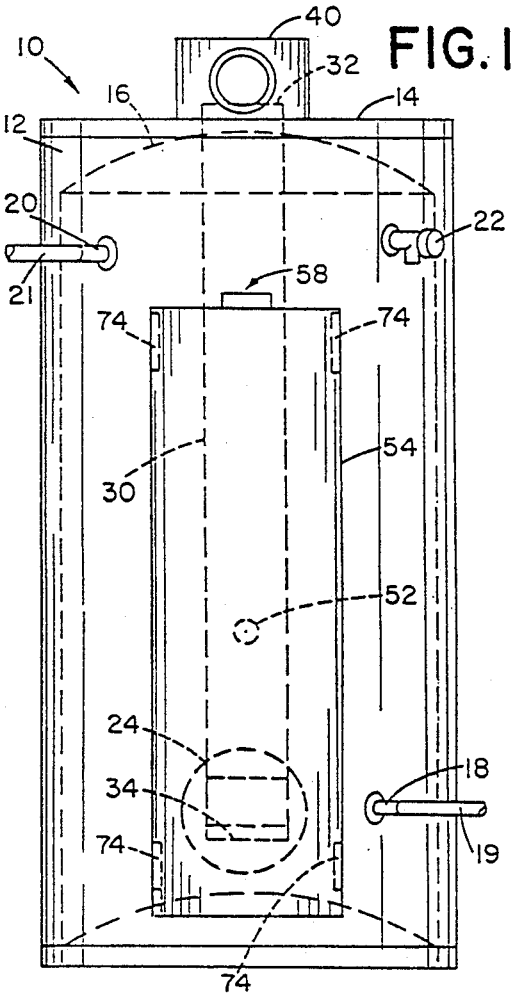
FIG. 1
FIG. 3
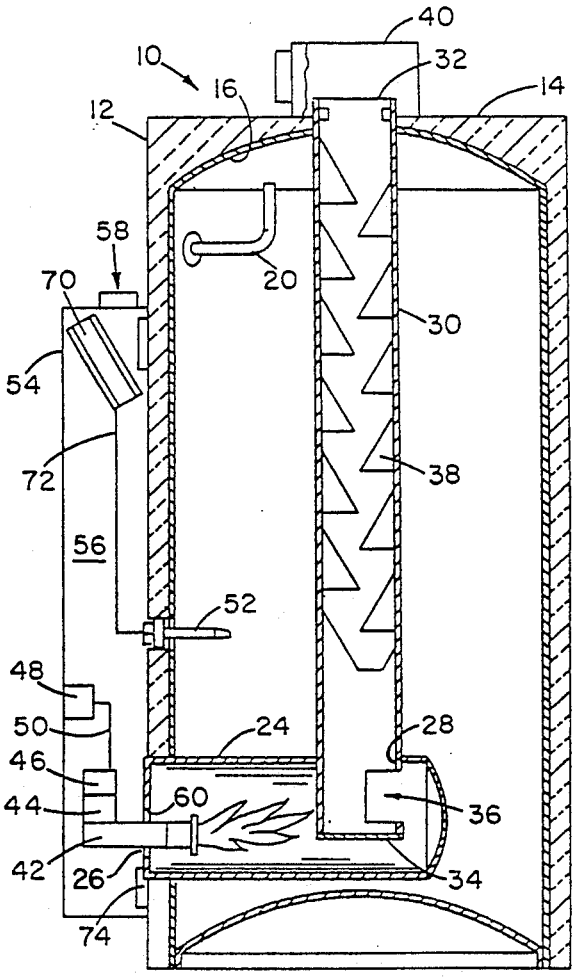

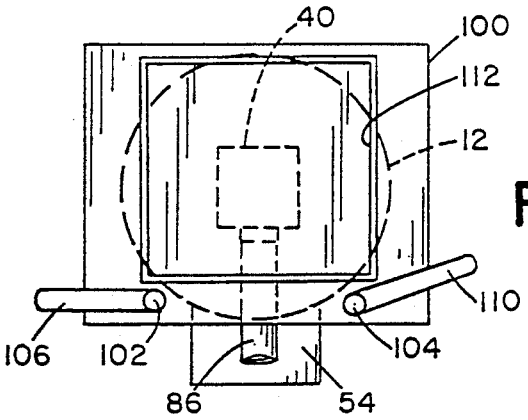
FIG. 7
FIG. 5
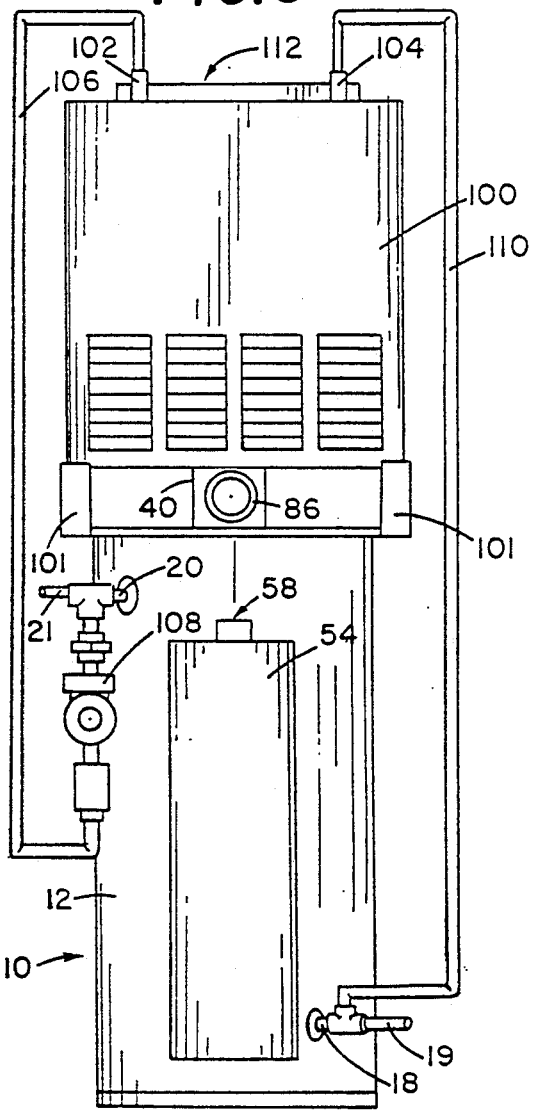
FIG. 6
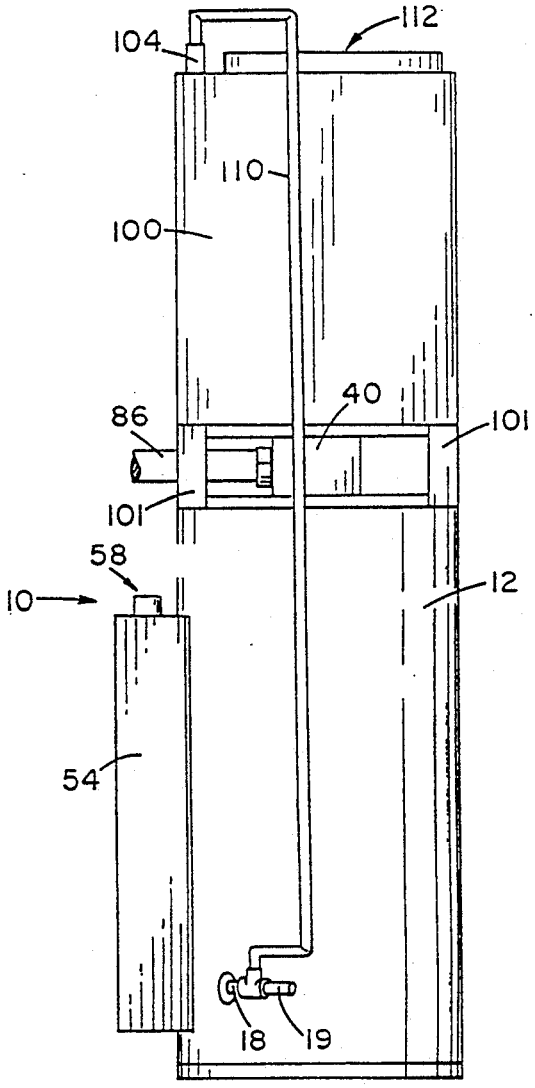

FORCED DRAFT DIRECT VENT SYSTEM FOR A WATER HEATER

This application is a continuation-in-part of co-pending application Ser. No. 268,716, filed Nov. 9, 1988 which issued on May 15, 1990 as U.S. Pat. No. 4,925,093, which is incorporated by reference herein.

The present invention relates to the art of air and water temperature conditioning, and more particularly to a water heater having a driven draft direct vent system combined with a modular air heater for supplying heated or cooled air to living space.

BACKGROUND OF THE INVENTION

Indoor water heaters of the domestic type usually comprises an upright generally cylindrical body including a tank for holding a quantity of water to be heated. A burner for natural gas, propane or other fuel is disposed within a combustion chamber which is associated with the lower region of the water heater tank to conduct the heat of combustion to the water contained in the tank. The combustion chamber includes a combustion air inlet opening and a flue gas outlet opening. A flue pipe extends from the flue gas outlet opening to a position at the exterior of the water heater body where a connection is made between the flue pipe and a chimney or other passageway leading to the outdoor atmosphere. The flue pipe usually extends through the tank of water in order to conduct additional heat into the water from the flue gases.

A particular type of conventional water heater employs an atmospheric burner to provide the heat of combustion at the combustion chamber. Combustion of fuel in the atmospheric burner normally derives necessary oxygen from the air surrounding the burner and the water heater. The products of combustion are vented by means of a natural draft developed by the heat of combustion at the burner as opposed to a draft driven by a fan or blower. Room air is drawn into the combustion air inlet opening as the heat of combustion causes flue gases and heated combustion air to flow through the flue gas outlet opening and upwardly through the flue pipe to the chimney connection.

Atmospheric burner water heaters of this type suffer from several disadvantages. The greatest disadvantage arises in the use of room air for combustion air at the burner. Use of room air inefficiently wastes the energy expended to heat, cool, or humidify that air since it is wastefully driven out of the building with the exhaust of flue gases. A further loss of room air occurs through the open arrangement of the vent hood over the flue pipe which permits room air to pass through the annular space therebetween and upwardly to the chimney with the rising flue gases. Another disadvantage is that the heated interior components of the water heater cause a residual convective flow to proceed through the water heater between intermittent operations of the burner. This not only wastes room air being drawn in through the combustion chamber inlet opening, but also wastes heat which is consequently drawn out of the heated components and the stored quantity of water by the residual convective flow. Furthermore, a draft of room air out of the building through the water heater tends to cause a corresponding draft of outdoor air into the building through cracks or other spaces in door and window frames to further disrupt heating or air conditioning systems.

Another type of domestic indoor water heater employs a power burner to provide the heat of combustion. A power burner is a device for providing a mixture of gaseous fuel and combustion air which is calculated to increase the efficiency of fuel consumption. A water heater system employing a power burner generally uses a centrifugal blower in a housing adapted to cause a pressurized flow of combustion air which is mixed with fuel and directed to the combustion chamber of the water heater. The flue pipe in such heaters may extend from the combustion chamber outlet opening through the tank of water in either a straight or an non-linear configuration to a position at the exterior of the water heater where a connection is made to a chimney or conduit extending to the outdoor atmosphere. A combustion air inlet conduit may be provided to extend from the outdoor atmosphere to the combustion chamber inlet opening to complete a driven draft direct vent system which vents the combustion chamber to the outdoor atmosphere in isolation from indoor room air. One such water heater is described in U.S. Pat. No. 4,766,883 assigned to the assignee of this application.

Water heaters having power burners also suffer from several disadvantages. A complex control system is required to operate the gas valve and to operate the blower. A complex fuel pressure regulating device requiring precise adjustment upon installation is often used. Power burner systems also disadvantageously consume electricity to drive the centrifugal blower and to operate the control system in addition to the consumption of gaseous fuel. Centrifugal blowers consume greater amounts of electrical energy than do simple propeller fans, but are used in order to meet the pressure requirements of the power burner as well as to drive the venting flow. Furthermore, if a direct vent system is not provided and combustion air is drawn from the surrounding room instead of from the outdoor atmosphere, the higher pressure requirements of the power burner system will cause an even greater loss of conditioned room air than is experienced in the natural draft atmospheric burner systems described above.

It is sometimes desirable to employ the heated water from the water heater to heat room air in the building in which the water heater is installed. Water heaters having power burner systems are known to have been adapted for this purpose. Heated water is pumped from the tank in the water heater to a coil exposed to the room air, and is returned to the tank in a cycle separate from the ordinary flow of hot and cold potable water through the water heater and associated plumbing. The coil is associated with an existing space heating system at an air duct or plenum. Such attempts to provide a combination water heater-space heater thus require plumbing connections to be made through the room space between the water heater and the existing space heating system, and disadvantageously occupy and limit available room space in utility rooms or other similarly cramped indoor locations where these appliances must be installed. Such systems also require an "engineered" approach in that matching of the water heater to existing or available space heating components can be complex.

Disadvantages common to both atmospheric burner and power burner systems include the location of the gas valve and associated components at the exterior of the water heater body. Exposure of these components could subject them to damage upon shipment or installation, or to improper adjustment by untrained personnel after installation. These components also present a somewhat inappropriate appearance for a finished basement utility room, laundry room or other common household location of a water heater.

Known water heaters are thus seen to fail to provide a venting system which efficiently operates in isolation from indoor room air without requiring the use of complex electrical components such as fluid pressure regulators and energy consuming centrifugal blowers, or to provide an unobtrusive and compact arrangement of components to serve as a combination water heater and space heater.

In the co-pending application Ser. No. 268,716 of which this application is a continuation-in-part, an invention overcoming many of the above-referred to disadvantages is disclosed. The invention provides for an indoor domestic type gas heater having a driven draft direct vent system for an atmospheric burner. The invention is also adaptable for use as a combination water heater and space heater. This system provides not only for the heating of water for human consumption and use, but also for the heating of indoor room air.

The space heater is located atop of the water heater and includes a coil in a closed cycle water loop extending between the water heater tank and the space heater. The space heater is adapted to heat room air by flow across the coil heated by hot water from the water tank.

Although the vertical alignment of the water heater and space heater is a compact and space saving arrangement, elements such as the pipe linkage and an associated pump for communicating water between the two components is exposed. Moreover, the linkage prevents easy attachment and separation of the two components. Consequently, skill and knowledge of the structure is necessary to replace and/or separate the water heater from the space heater should either need replacement or repair.

SUMMARY OF THE INVENTION

The present invention overcomes the above-referred to disadvantages and others and provides an indoor domestic type gas water heater having a driven draft direct vent system for an atmospheric burner, and which is adaptable for use as a combined air and water temperature conditioning system for heating water and for heating or cooling indoor room air in a compact and rugged arrangement of components.

In accordance with the invention, there is provided a combined air and water temperature conditioning system for heating water and for heating indoor room air, comprising a domestic type water heating and an air handler. The water heater includes a tank having a cold water supply inlet, a hot water supply outlet, a water circulator outlet and a water circulator inlet. The air handler is mounted on top of the water heater and has a housing, an air blower situated in an air path between an air inlet and an air outlet, and a water fed heating coil situated in the air path and having a water inlet connected to the circulator outlet of the water heater and a water outlet connected to the circulator inlet of the water heater. As a result, water is heated by the water heater for human consumption and for use by the air handler in heating room air.

Yet another feature of the invention is an air handler of modular design having the water outlet and inlet located at its base which is contiguous to the top of the water heater. The water inlet and outlet is connected to the water heater circulator outlet and inlet, respectively, located at the top of the water heater.

Further in accordance with the invention, the water outlet and inlet are provided with quick disconnect couplings to the water heater circulator inlet and outlet.

Yet further in accordance with the invention, said air handler is provided with a water circulator pump within the air handler housing selectively driving circulation of water through the heating coil and a circulator pump and blower controller within the housing activating and deactivating the pump and blower.

Still further in accordance with the invention, a second coil is provided in the air path in the air handler housing adapted to provide air conditioning and/or supplemental heating.

In accordance with another specific feature of the invention, brackets are provided on both sides of said air handler housing whereby said second coil may be slidably inserted and mounted in either a right hand position or a left hand position.

In accordance with a further aspect of the invention, the second coil is connected to an air conditioner condenser unit and the pump and blower controller includes switches which allow actuation of the blower without actuation of the circulator pump, whereby the air handler selectively functions to cool room air.

The primary object of the invention is to provide a self-contained unit for heating water and for heating and/or cooling room air which is compact, modular in design and allows the air handler to be separated from the water heater in the field.

Another object of the invention is to provide a system for extracting heat from water heated by a water heater and transferring the heat to room air which is compact and rugged.

A further object of the invention is to provide a combined air and water temperature conditioning system which conserves space and which can be placed within a small room, such as a closet, due to its compact arrangement of components.

Yet another object of the present invention is to provide a combined air and water temperature conditioning system which can be located up to 25 feet from a chimney or exterior wall, which produces exhaust gases which can be transported in high temperature plastic pipe, which uses outside air for combustion air, and which can be mounted directly adjacent interior walls.

Still another object of the invention is to provide a combined air and water temperature conditioning system which includes an insertable second coil on the right or left side of a housing for connection to an air conditioner condensing unit or heat pump.

These and other objects of the invention will become apparent from the following detailed description of a preferred embodiment thereof and from the accompanying drawings.

BRIEF DESCRIPTION OF THE DRAWINGS

In the drawings:

FIG. 1 is a front elevational view of a water heater constructed in accordance with one aspect of the invention;

FIG. 2 is a top plan view of the water heater shown in FIG. 1;

FIG. 3 is a cross-sectional view taken on line 3—3 of FIG. 2;

FIG. 5 is a front elevational view of the water heater shown in FIG. 1 as adapted as a combination water heater.

FIG. 6 is a side elevational view of the combination water heater and space heater shown in FIG. 5;

FIG. 7 is a top plan view of the combination water heater and space heater shown in FIG. 5;

PREFERRED EMBODIMENT OF THE INVENTION

Figure 4:
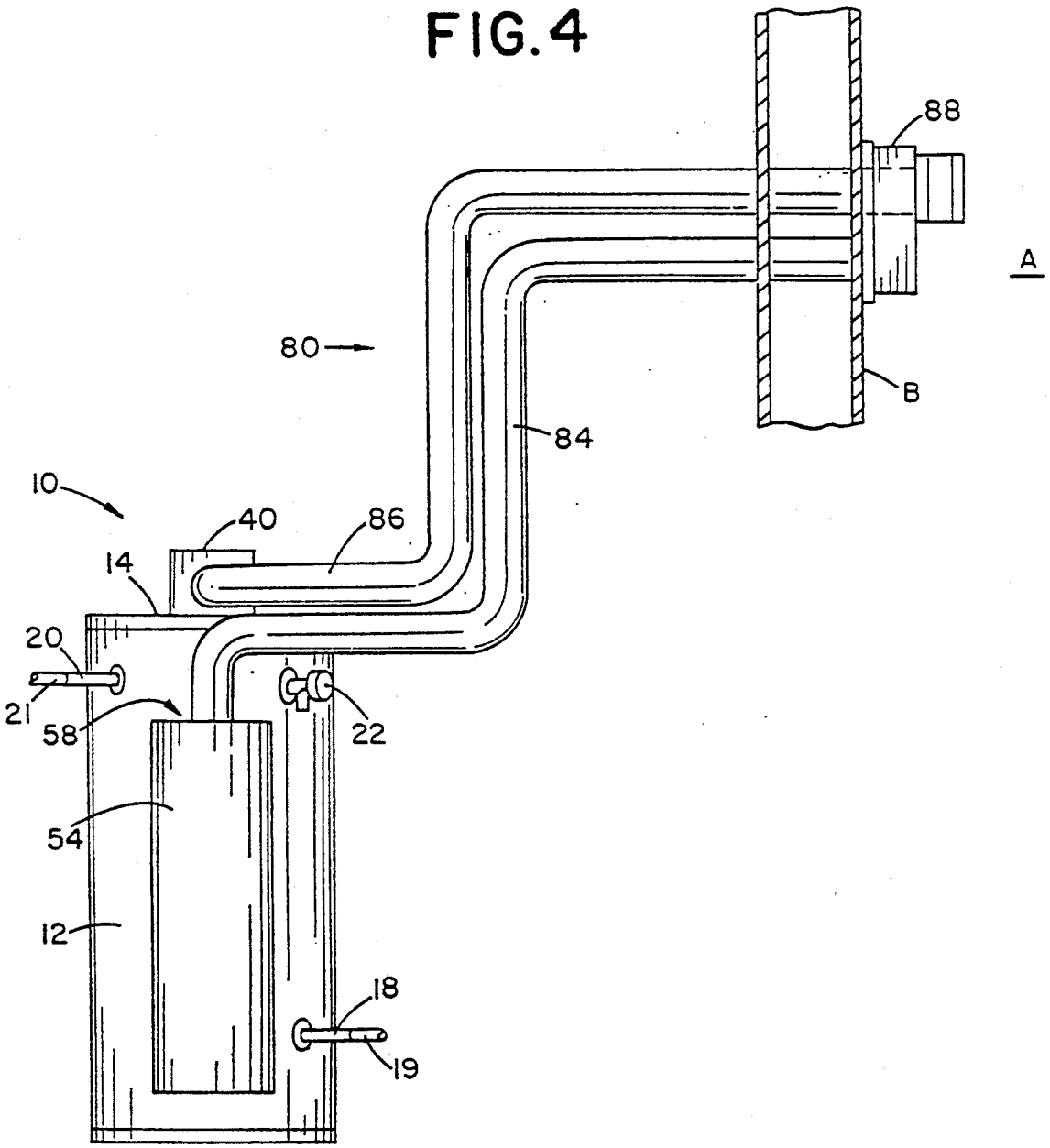
FIG. 4 is a front elevational view of the water heater shown in FIG. 1 as provided with a forced draft direct vent system.

Referring now to the drawings wherein the showings are for the purposes of illustrating a preferred embodiment of the invention only and not for the purpose of limiting the same, in FIG. 1 there is shown a front elevational view of a water heater constructed in accordance with the invention. The water heater 10 has generally elongated upright exterior contour defined by a cylindrical exterior wall 12 and a generally flat top surface 14, and includes a tank 16 adapted to store a quantity of water to be heated, a cold water inlet 18 fed by a cold water to be heated, a hot water outlet 20 feeding a potable hot water line 21, a pressure and temperature relief valve 22, and a submerged combustion chamber 24 associated with the tank 16 to conduct heat of combustion to the stored water. In the preferred embodiment the combustion chamber 24 is a submerged type combustion chamber as disclosed in U.S. Pat. No. 4,660,541 which is incorporated herein by reference. The combustion chamber 24 includes an inlet opening 26 and a outlet opening 28. A flue pipe 30 extends from the outlet opening 28 vertically through the tank 14 to an open upper end 32 at the top surface 14 of the water heater 10. The flue pipe 30 includes a lower end 34 extending downwardly into the combustion chamber 24 and having a flue gas inlet opening 36 facing in a direction away from the combustion chamber inlet opening 26 as shown. The flue pipe 30 may include baffles 38 in a conventional manner. A flue collector box 40 is provided over the open upper end 32 of the flue pipe 30 to define an air flow passageway between the flue pipe 30 and an outlet conduit means to be described in detail hereinafter with reference to FIG. 4.

A combustion means is provided to include an atmospheric burner, a gas valve, and a gas igniter. An atmospheric burner 42 extends into the combustion chamber 24 through the combustion chamber inlet opening 26. Shown schematically in FIG. 3 is a gas valve 44 adapted to controllably permit a flow of gaseous fuel from a source (not shown) to the atmospheric burner 42. The atmospheric burner 42 has an air opening (not shown) into which combustion air is drawn by the flowing gaseous fuel for mixture therewith. Also shown schematically in FIG. 3 is an igniter 46 adapted to ignite the mixture of fuel and air. The igniter 46 may also serve as a flame detector as part of a safety shut-down system in a known manner. Also shown schematically in FIG. 3 is an air pressure sensor 48 which is operatively connected to the combustion means through a first electrical connection 50. A water temperature thermostat means 52 extends through the exterior body wall 12 into the tank 14.

A housing 54 is positioned at the side of the water heater 10 to define, along with the water heater exterior body wall 12, an air pressure chamber 56. The air pressure chamber 56 has a first opening 58 communicating with the exterior of the housing 54, and a second opening 60 communicating the air pressure chamber 56 with the combustion chamber 24. The second opening 60 of air pressure chamber 56 preferably coincides with the combustion chamber inlet opening 26. As shown in the figures, the housing 54 encloses the atmospheric burner 42, the gas valve 44, the igniter 46, the pressure sensor 48, and the thermostat means 52. Disposed within the housing 54 adjacent the first opening 58 is a combustion air propeller fan 70. The fan 70 is operatively connected to the thermostat means 52 by a second electrical connection 72. In the preferred embodiment shown in the figures, the fan 70 is positioned to drive a forced draft as opposed to an induced draft, but the invention is understood not to be limited to this preferred type of driven draft. To provide service access to the enclosed components, the housing 54 may be releasably attached to the water heater exterior body wall 12 by vertical sliding brackets 74 or other releasable fastening means, or may be more securely attached, such as with machine screws. Alternatively, an access panel could be provided in the housing. Gaskets may be provided as required. An air flow path reaching into the combustion chamber and including an air pressure zone in which the draft air pressure developed by the fan is sensed and reacted to by the air pressure sensor is thus provided.

Operation of the forced draft system is initiated when the thermostat means 52 detects a minimum or a low water temperature within the tank 14. The thermostat means 52 then causes the combustion air fan 70 to draw air in through the first opening 58 thereby to pressurize the air pressure chamber 56. The air pressure sensor 48 responds to a predetermined level of increased pressure within the air pressure chamber 56 to activate operation of the combustion means, which energizes the igniter 46 and opens the gas valve 44, preferably after an igniter warm-up period. A force draft proceeds as combustion air flows through the air pressure chamber 56 into the combustion chamber 24, and as the flue gases and heated combustion air are driven out of the combustion chamber 24 through the flue pipe 30 to the flue collector box 40 at the top of the water heater 10. The thermostat means 52 shuts down the combustion air fan 70 upon detection of a predetermined elevated water temperature, thus causing a reduction in pressure within the air pressure chamber 56. The air pressure sensor 48 then responds to the reduced pressure to shut down the combustion means until the heating cycle is repeated.

As shown in FIG. 4, the water heater 10 is provided with a direct vent system including a conduit assembly 80 extending from the water heater 10 through an exterior building wall B to the outdoor atmosphere A. The conduit assembly 80 comprises an outlet conduit 82 communicating the flue collector box 40 with the outdoor atmosphere A, and an inlet conduit 84 communicating the outdoor atmosphere A with the first opening 58 of the housing 54. The outlet conduit 82 includes a horizontal outlet conduit section 86 extending from the flue collector box 40 to a position spaced away from the exterior body wall 12 of the water heater 10. The inlet conduit 84 likewise extends laterally away from the water heater 10 before turning vertically upward as shown. The outlet conduit 82 and the inlet conduit 84 separately communicate with the outdoor atmosphere A at a common vent terminal 88.

As shown in FIGS. 5 through 7, the water heater 10 may be adapted as a combination water heater and space heater in accordance with the invention. An air handler 100 is mounted atop the water heater 10 on a framework comprising brackets 101. The horizontal outlet conduit section 86 extends from the flue collector box 40 beneath the air handler 100. The air handler 100 is provided with a hot water coil connection 102 and a cold water coil connection 104. A hot water coil 103 within the air handler 100 is connected to a water line communicating with the hot water coil connection 102 and with the cold water coil connection 104. A coil supply line 106 extends from the hot water outlet 20 at the water heater 10 to the water coil connection 102 at the air handler 100 separately from the potable hot water line 21 and includes a pump 108. A coil return line 110 extends from the cold water coil connection 104 at the air handler 100 to the cold water inlet 18 at the water heater 10 separately from the cold water source line 19. A duct opening 112 at the top of the air handler 100 is adapted for connection to the duct work of the space heating system of the building in which the combination water heater and space heater is installed. Also included within the air handler 100 and not shown in the drawings is an air blower adapted to draw indoor room air into the air handler 100 and to cause a pressurized flow of the indoor room air across the hot water coil. The combination water heater and space heater thus provides a source of heat for indoor room air at the hot water coil which is brought to an elevated temperature by circulation of hot water through the combined components by the pump 108.

Figure 8:
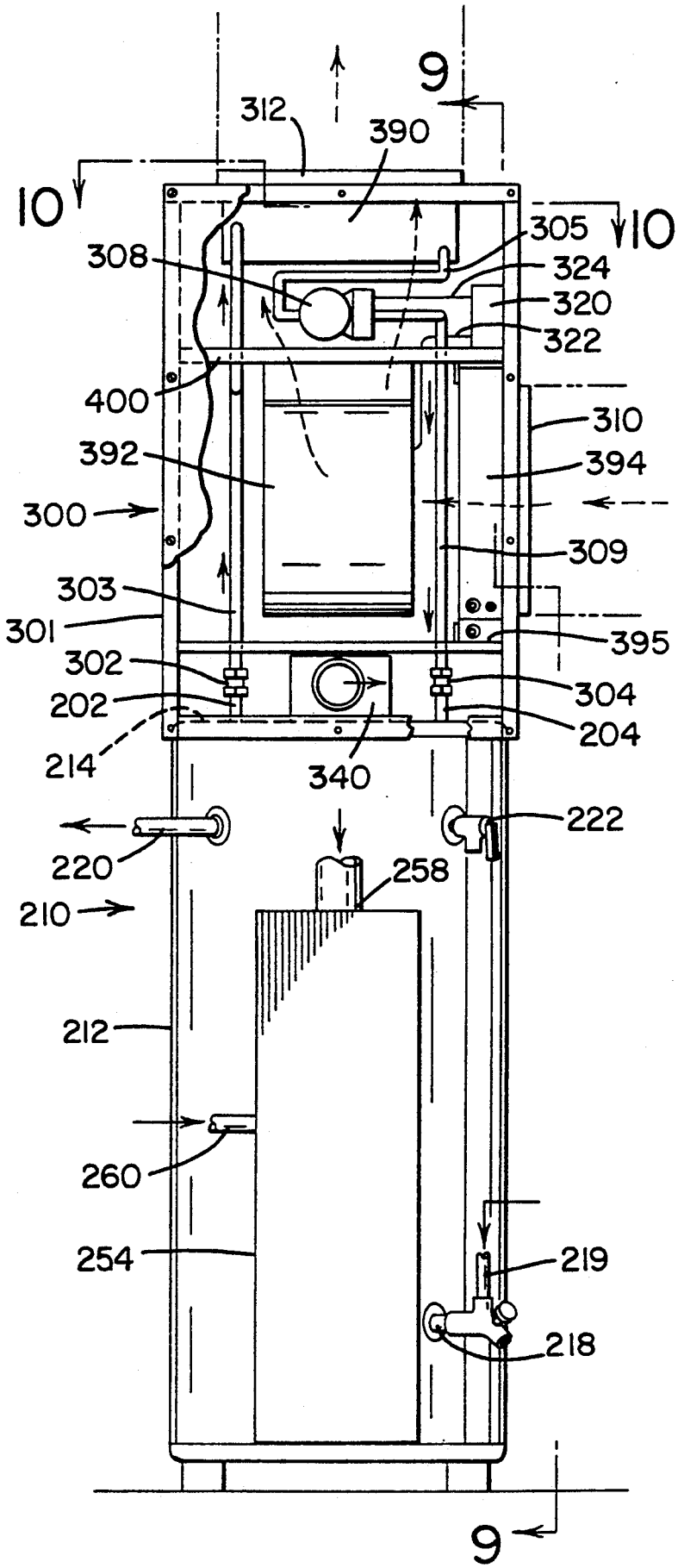
FIG. 8 is a front elevational view of a second embodiment of a combined space and water temperature conditioning system in accordance with the invention.

In FIG. 8, there is shown a front elevational view of a second combined air and water temperature conditioning system in accordance with the invention. The water heater 210 has a generally elongated upright exterior contour defined by a cylindrical exterior wall 212 and a generally flat top surface 214. The water heater 210 includes a tank adapted to store a quantity of water to be heated, a cold water inlet 218 fed by a cold water source line 219, a hot water outlet 220 dispensing potable hot water, a water circulator outlet 202 dispensing hot water to the air handler 300, a water circulator inlet 204 receiving water from the air handler 300, and a temperature and pressure relief valve 222. The water heater 210 further comprises a housing 254 associated with a driven draft direct vent system for providing an air pressure chamber for a combustion chamber not shown. Penetrating the housing 254 is a first opening 258 which permits air to flow into the air pressure chamber within the housing 254 and a gas inlet 260 supplying gas to an atmospheric burner within a combustion chamber not shown. The operation and structure of the water heater 210 is similar to the structure and operation of the water heater 10 previously described.

The air handler 300 is mounted at the top surface 214 of the water heater 210. A horizontal outlet conduit section 386 (FIG. 9) extends from the flue collector box 340 and permits the explusion of the flue gases from the water heater 210. The air handler 300 is provided with a quick disconnect type water inlet 302 and a quick disconnect type water oulet 304 connected respectively to the water circulator outlet 202 and the water circulator inlet 204 of the water heater 210. A hot water heat exchanger coil 390 is placed within the air handler 300. The coil 390 receives hot water through a water line 303 communicating with the water inlet 302. Water flows from the coil 390 through a waterline 305 into a pump 308 and is returned to the water heater through a waterline 309 and a water outlet 304 when the pump 308 is operating. Arrows in FIG. 8 indicate the direction of water flow.

Figure 11:
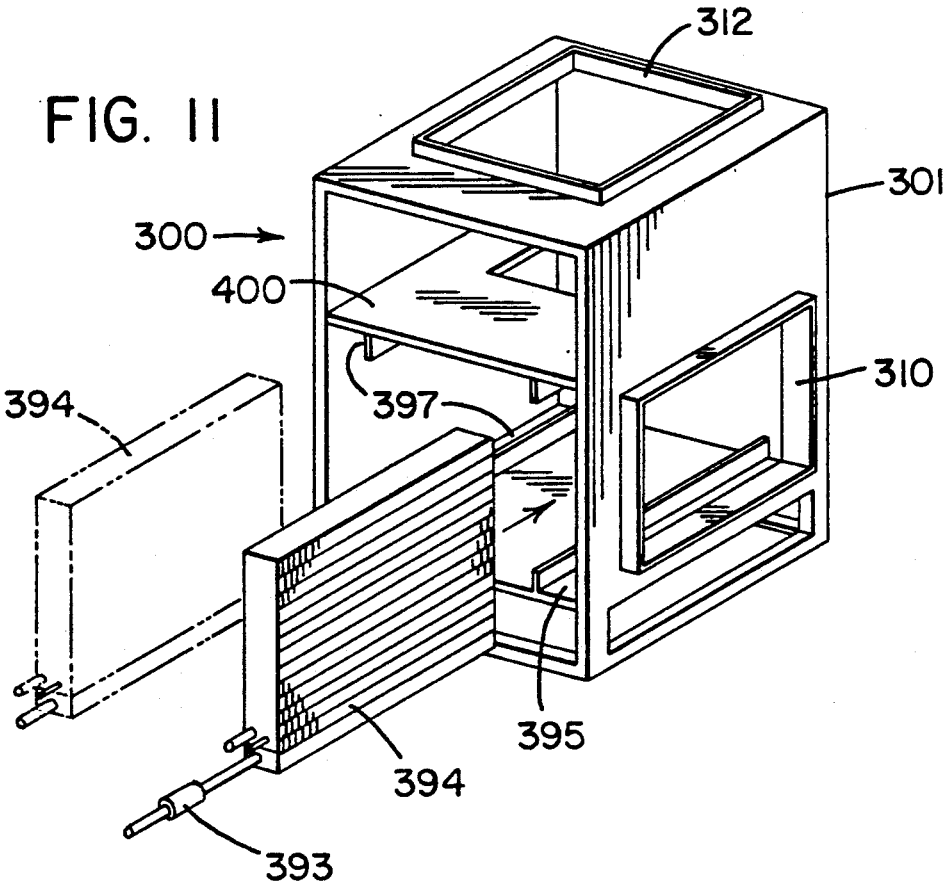

Air flow through the air handler 300 is shown by dashed arrows in FIG. 8. Indoor room air enters an air inlet 310 shown on the right side panel of the air handler 300. It is appreciated that this inlet may be situated on any side of the air handler 300. In the preferred embodiment provisions are made for right side or left side entry (FIG. 11). After entry into air inlet 310, the air continues through blower 392 which propels the air through the hot water coil 390 and ultimately out from air outlet 312. An insertable second coil 394 is optionally mounted within the flow path of air running through the air handler 300. The insertable coil may be a heating and cooling coil from a heat pump or a cooling coil from an air conditioner. As a heating coil, it can be used alone or to supplement the heating coil 390 to transmit heat to incoming air. If the insertable second coil is a cooling coil, the air handler 300, upon deactivation of the pump 308 through appropriate switches, normally associated with a home thermostat, may be utilized as a cooling system for indoor room air. The insertable second coil is provided with an adjustable metering device 393 to restrict the flow of coolant through the coil 394 to acceptable levels when the unit is used with a one ton, one and a half ton, or two ton capacity air conditioning condenser.

Figure 9:
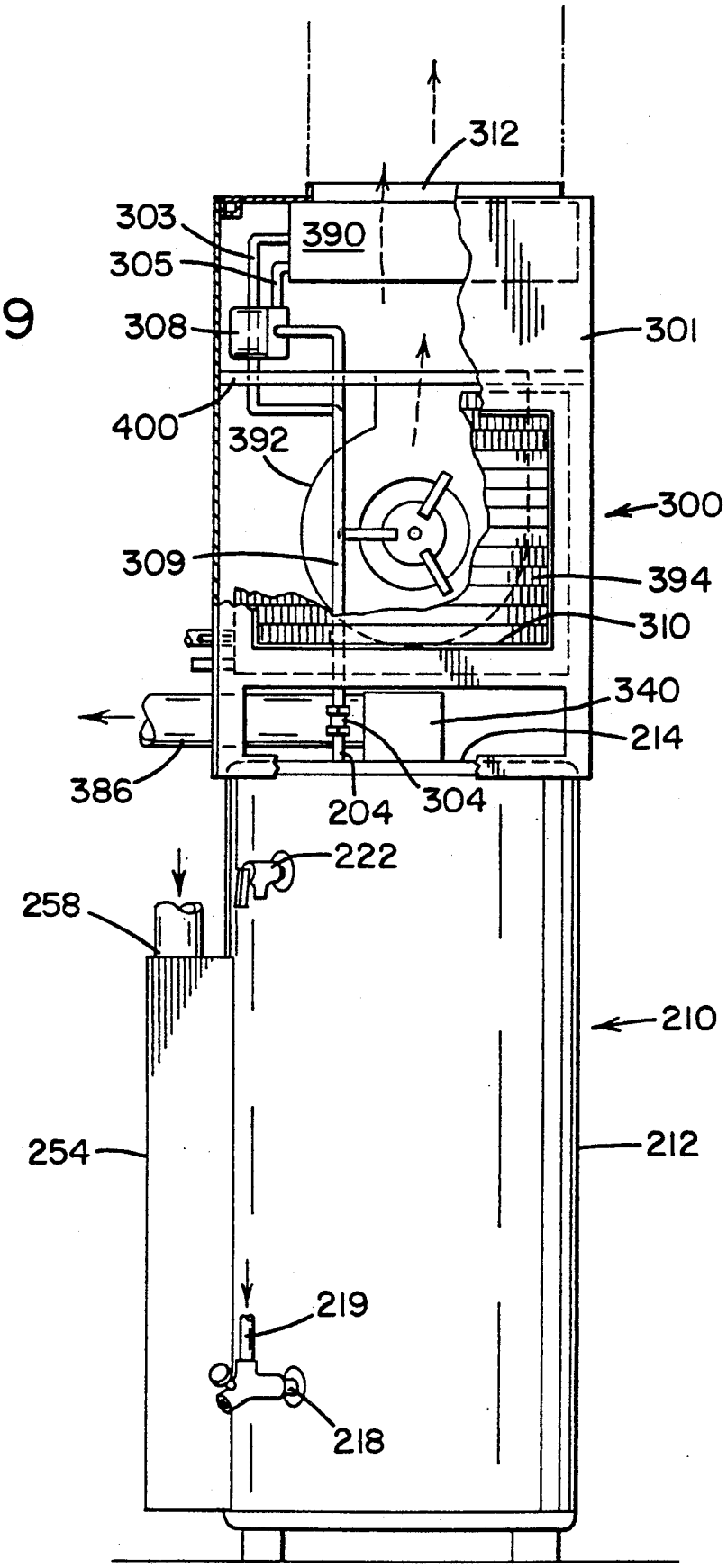
FIG. 9 is a side elevational view taken on line 9—9 of the combined air and water temperature conditioning system shown in FIG. 8.

FIG. 9 is a side elevational view of the combined air and water temperature conditioning system shown in FIG. 8. The blower 392 is situated in the air path and draws air through the insertable second coil 394 from the inlet 310 and propels the air through coil 390 and out of air outlet 312.

The blower 392 is conventionally driven by an electric motor (not shown). The blower 392 and the pump 308 are furnished power, and thus controlled, by an air handler controller 320 (FIG. 8 only) through electrical lines 322 and 324 respectively. When air cooling is called for, the blower 392 is turned on and room air drawn through the insertable second coil 394 where it is cooled by action of a conventional air conditioner arrangement. The pump 308 is not energized and air is not heated by passing through the coil 390. The stopped pump 308 prevents the convective flow of water through the air handler 300 and conserves the heated water in the water heater 210.

When air heating is required by the home thermostat, the blower is turned on by the controller 320. If the building being heated is provided with a heat pump and the heat pump has been selected as the primary source of heat, the heat pump is activated and heated fluid is passed through the insertable coil heat exchanger 394. The operation of the blower 392 draws air through the coil 394, heating it, and discharges it through the air outlet 312 into the building heating ducts. Should conditions, such as extreme weather, prevent the heat pump from supplying adequate heat, the controller 320, turns the pump 308 on and hot water is drawn from the water heater 210 through the heater exchanger coil 390. The building air is heated as it passes through the coil 390. As heat is drawn from the water heater 210, the water heater controls, as described with respect to FIG. 3, activate the burner and heat is supplied to the water. The control components and logic used to control a heat pump and heat source of the present invention in this mode of operation have conventionally been used to control an electric resistance heating element or the like in an electric home furnace. Electric resistance heating is significantly more expensive than gas heating, as used in the present invention.

When the air handler 300 is used without a heat pump, the pump 308 and the blower 392 are turned on in unison when heat is demanded.

Importantly, the electrical control systems for the air handler 300 and the water heater 210 are completely separate, should one of these systems fail or malfunction, the other is not effected. Further, the mechanical elements of the air handler 300 and the water heater 210 are modular in design and easily disconnected. Should either the air handler 300 or the water heater 210 require replacement or removal for repair, the air handler 300 can be easily removed from the water heater 210. Disconnection of the disconnects 302, 304 and physical separation of the devices allows one to remove either without disconnecting the other. A new unit can then be inserted without undue difficulty.

An arrow associated with the water heater horizontal flue gas outlet conduit section 386 illustrates the flow path of flue gases emitted from the water heater 210. An arrow associated with the first opening 258 of the housing 254 indicates the flow path of indoor room air into the air pressure chamber related to the combustion chamber of the water heater 210. Both of these flow paths are substantially independent and do not interfere with modularity.

Figure 10:
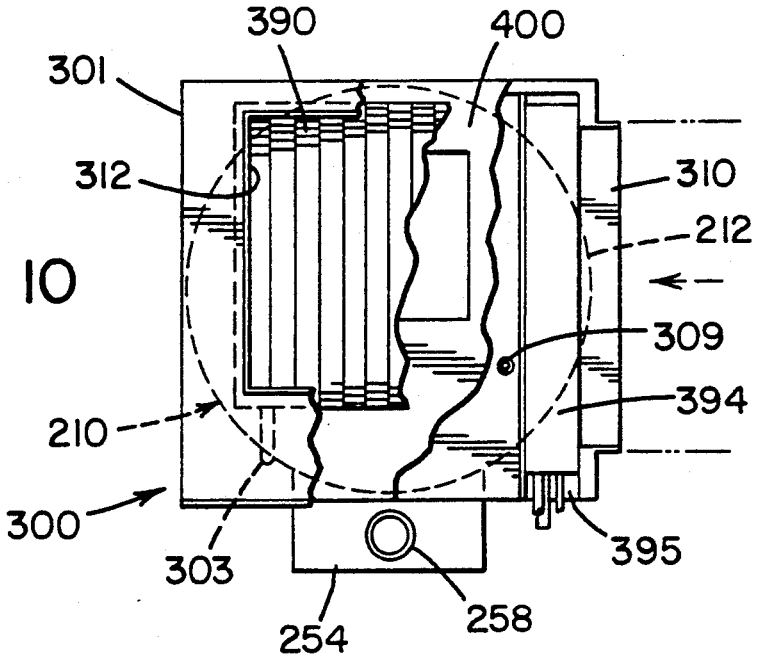
FIG. 10 is a top plan view partially cut away on line 10—10 of the combined space and water temperature conditioning system of FIG. 8; and, FIG. 11 is an isometric view of the air handler of the combined air and water temperature conditioning system shown in FIGS. 8, 9 and 10.

FIG. 10 is a top plan view of the combined air and water temperature conditioning system of FIGS. 8 and 9. A circular phantom line illustrates the wall 212 of the water heater 210 and, thus, the compact footprint of the entire system. An arrow indicates the flow path of incoming indoor room air into the air handler air inlet 310, either from a cold air return duct or through a louver, which eventually is transmitted through coil 390 located above the panel 400.

FIG. 11 illustrates an isometric view of the housing 301 of the air handler 300. The insertable second coil 394 may be situated in the air path of the air handler 300 on either the right or left side to accommodate air return duct work or the like. Any type of coil known in the art for heating or cooling or both can be utilized resulting in a versatile building air heating and/or cooling system. As previously described, the insertable second coil 394 may be connected to an air conditioner or heat pump. Insertion of insertable second coil 394 into bracket 395 is indicated by a corresponding arrow. The installed location of the coil 394 is in a position in line with incoming room air flowing through the air inlet 310. An alternative bracket 397 permits insertion of the insertable second coil 394 on the side of the air handler 300 opposing the bracket 395. This alternative insertion of insertable second coil 394 would require a cutout in the housing 301 for admission of incoming air.

While not shown in the drawings, a check valve should be inserted in the piping to the hot water coil 390 to prevent thermosyphoning and a bleed valve located near the coil 390 to purge air from the system.

The invention has been described with reference to preferred embodiments. Obviously, modifications and alterations will occur to others upon the reading and understanding of the specification. It is intended to include all such modifications and alterations insofar as they come within the scope of the appended claims and the equivalents thereof.

Having thus described the invention, it is claimed:

1. A combined air and water temperature conditioning system for heating water and for heating or cooling indoor room air, comprising:

a domestic type water heater including a water tank having a cold water supply inlet, a hot water supply outlet, a water circulator outlet, a water circulator inlet, a top having a top edge, a combustion chamber wherein fuel is consumed producing products of combustion adjoining said tank whereby heat is directly transferred from said combustion chamber to said tank, a flue communicating with said combustion chamber passing through said tank and exiting said top, a modular air handler mounted on said top of said water heater having a housing with an air inlet and an air outlet, an air blower situated in an air path within said housing between said air inlet and said air outlet, a water-fed heating coil situated in said air path and having a water inlet connected to said circulator outlet of said water heater and a water outlet connected to said circulator inlet of said water heater and a water pump located in said housing adapted to cause circulation of water from said water heater to said heating coil when energized, and a flue gas conduit having a substantially horizontal segment positioned below said air handler communicating with said flue, said horizontal segment conducting the products of combustion laterally beyond the edge of said top end.

2. A combined air and water temperature conditioning system as defined in claim 1, wherein said water circulator inlet is located on said water heater top and said water heater circulation outlet is located on said water heater top.

3. A combined air and water temperature conditioning system as defined in claim 1, wherein said air handler water outlet and said air handler water inlet are detachably connected to said water heater circulator inlet and circulator outlet.

4. A combined air and water temperature conditioning system as defined in claim 1, wherein said air handler has a generally rectangular housing, said air inlet is located on a side of said air handler housing and said air outlet is located on the top of said air handler.

5. A combined air and water temperature conditioning system as defined in claim 1, wherein said air handler includes an insertable coil for affecting the temperature of air flowing in said air path in said air handler.

6. A combined air and water temperature conditioning system as defined in claim 5, wherein said insertable coil is located adjacent said air inlet.

7. A combined air and water temperature conditioning system as defined in claim 6, wherein said insertable coil is adapted to cool air flowing in said air path in said air handler.

8. A combined air and water temperature conditioning system as defined in claim 5, wherein said insertable coil is mounted in said air handler by sliding type brackets.

9. A combined air and water temperature conditioning system for heating water and for cooling or heating indoor room air, comprising:

a domestic type water heater having a water tank having a top end, a top edge, a combustion chamber wherein fuel is consumed producing products of combustion adjoining said tank whereby heat is directly transferred from said combustion chamber to said tank, a flue communicating with said combustion chamber passing through said tank and exiting said top end, a flue gas conduit having a substantially horizontal segment, an air handler of modular design mounted atop of said water heater having a blower adapted to provide a current of air across a heating coil containing water from said water heater, and said water heater having a top adapted to accommodate said modular air handler on said top, said flue gas conduit horizontal segment extending laterally beyond said top edge below said air handler and the combination of said air handler and said water heater forming a self-contained unit with water heated by said water heater being transferred to and returned from said air handler internally to said unit.

10. A combined air and water temperature conditioning system as defined in claim 9, wherein said water heater includes a driven draft direct vent system comprising a housing associated with the exterior of said water heater body to provide an air pressure chamber defined in part by said water heater body and in part by walls of said housing, said air pressure chamber having a first opening communicating with the exterior of said housing, and a second opening communicating with a combustion air inlet passage, a combustion air fan operatively associated with said first opening to move air into said air pressure chamber, and an inlet conduit assembly extending from said first opening to the outdoor atmosphere.

11. A combined air and water temperature conditioning system as defined in claim 9, wherein said water heater includes a flue pipe terminating at an open end atop said water heater and an outlet conduit assembly communicating said open end of said flue pipe with the outdoor atmosphere, said outlet conduit assembly including a first section extending horizontally from said open end of said flue pipe to a position laterally spaced from said water heater.

12. A combined air and water temperature conditioning system as defined in claim 9, wherein said air handler has a generally rectangular housing, said air inlet is located on a side of said housing and said outlet is located on the top of said housing.

13. A combined air and water temperature conditioning system as defined in claim 9, wherein said air handler includes an insertable coil means for affecting the temperature of said current of air.

14. A combined air and water temperature conditioning system as defined in claim 10, wherein said water heater has an electrical control system and said air handler has an electrical control system and said water heater electrical control system is entirely separate from said air handler electrical control circuit.

15. A modular combination water heater and space heater comprising:

a water heater adapted to heat a body of water having a top end, a water containing tank, a combustion chamber adjoining said tank wherein fuel is consumed producing products of combustion adjoining said tank whereby heat is directly transferred from said combustion chamber to said tank, a flue communicating with said combustion chamber passing through said tank and exiting said top end, a flue gas conduit segment conducting said products of combustion away from said water heater, a cold water inlet, and a hot water outlet;

an air handler assembly comprising a housing a water line including a hot water coil connection opening to the exterior of said housing, a coil supply line communicating said hot water outlet with said hot water coil connection, a cold water coil connection opening to the exterior of said housing, a coil return line communicating said cold water inlet with said cold water coil connection, a coil within said housing communicating said hot water coil connection with said cold water coil connection, a duct opening communicating the exterior of said housing with the surface of said coil, and a blower adapted to move air into said housing through said duct opening and across said coil, said housing being mounted to said top end of said water heater above said flue gas conduit segment; and, a pump moving hot water from said water heater tank to said air handler through said water line.

16. A combination water heater and space heater comprising:

a water heater adapted to heat a body of water having a water containing tank, a combustion chamber adjoining said tank in which fuel is consumed producing heat and products of combustion whereby heat is directly transferred from said combustion chamber to said tank, a top end, a cold water circulator inlet, a hot water circulator outlet, a flue communicating with said combustion chamber passing through said tank and exiting said top end and a water heater thermostat sensing the temperature of water in said tank and initiating operation of said water heater in response to a low temperature condition within said tank;

an air handler assembly mounted on said top end comprising a housing; a water line comprising a heat exchanger, a pump, a cold water return line communicating said heat exchanger to said cold water circulator inlet, a hot water line communicating said heat exchanger to said hot water circulator outlet; an inlet air opening, an outlet air opening, a blower adapted to move air into said inlet opening, through said heat exchanger and out said outlet opening, a control unit controlling said blower and said pump in response to demand for air heating.

17. The combination water heater and space heater of claim 16 wherein said water circulator inlet is in said top end, said water circulator outlet is in said top end, said pump is contained within said housing; and, said air handler water line is contained within said housing and between said housing and said water heater.

18. The combination water heater and space heater of claim 16 wherein said flue communicates with a flue gas conduit having a substantially horizontal segment positioned below said air handler assembly communicating with said flue, said horizontal segment conducting the products of combustion laterally beyond the edge of said top end.

19. The combination water heater and space heater of claim 16 wherein said water heater additionally comprises a cylindrical side wall, a cold water source inlet in said side wall and a potable hot water outlet in said side wall.

20. A combination water heater and space heater comprising:

a water heater adapted to heat a body of water having a water containing tank, a combustion chamber adjoining said tank in which fuel is consumed producing heat and products of combustion whereby heat is directly transferred from said combustion chamber to said tank, a top end having an edge, a cold water inlet, a hot water outlet and a flue communicating with said combustion chamber passing through said tank and exiting said top end;

an air handler assembly comprising a housing, a water line comprising a hot water coil connection, a coil supply line communicating said hot water outlet with said hot water coil connection, a cold water coil connection, a coil return line communicating said cold water inlet with said cold water coil connection, a coil within said housing communicating said hot water coil connection with said cold water coil connection, a duct opening communicating the exterior of said housing with the surface of said coil and a blower adapted to move air into said housing through said duct opening and across said coil, said housing being mounted to said top end of said water heater;

a flue gas conduit having a substantially horizontal segment positioned below said air handler assembly communicating with said flue, said horizontal segment conducting the products of combustion laterally beyond the edge of said top end.

* * * * *

UNITED STATES PATENT AND TRADEMARK OFFICE

CERTIFICATE OF CORRECTION

PATENT NO. : 5,074,464

DATED : December 24, 1991

INVENTOR(S) : Henry J. Moore, Jr.; Wouter J. Wiersma; John M. Fabrizio

It is certified that error appears in the above-identified patent and that said Letters Patent is hereby corrected as shown below:

In the drawings, Sheet 2, Fig. 4, the reference numeral "82" should be applied to the vertical portion of conduit 86. Title Page, Item [56] after "4,641,631", patentee name "Satana" should read -- Jatana --. Column 1, line 17, "comprises" should read -- comprise --. Column 3, line 52 "heating" should read -- heater --. Column 5, line 6, after "heater" add --- and space heater --; line 36, "to be heated" should read -- source line 19 --; line 46, "14" should read -- 16 --. Column 6, lines 8 and 41, "14" should read -- 16 --. Column 7, line 18, cancel "103" and substitute -- (not shown) --. Column 9, line 21, "effected" should read -- affected --.

Signed and Sealed this

Twentieth Day of July, 1993

*Attest:*

*Attesting Officer*

Michael K. Kirk

MICHAEL K. KIRK

*Acting Commissioner of Patents and Trademarks*